US008365319B2

(12) United States Patent
Park

(10) Patent No.: US 8,365,319 B2
(45) Date of Patent: Feb. 5, 2013

(54) DRAIN DEVICE

(76) Inventor: Hee-beom Park, Seoul (KR)

( * ) Notice: Subject to any disclaimer, the term of this patent is extended or adjusted under 35 U.S.C. 154(b) by 0 days.

(21) Appl. No.: 13/266,447

(22) PCT Filed: May 3, 2010

(86) PCT No.: PCT/KR2010/002812

§ 371 (c)(1),
(2), (4) Date: Oct. 26, 2011

(87) PCT Pub. No.: WO2010/126345

PCT Pub. Date: Nov. 4, 2010

(65) Prior Publication Data

US 2012/0047646 A1 Mar. 1, 2012

(30) Foreign Application Priority Data

May 1, 2009 (KR) ..... 10-2009-0038643

(51) Int. Cl.
*E03D 13/00* (2006.01)

(52) U.S. Cl. ..... 4/301

(58) Field of Classification Search ..... 4/300–352, 4/301

See application file for complete search history.

(56) References Cited

FOREIGN PATENT DOCUMENTS

| | | |
|---|---|---|
| EP | 1460187 | 9/2004 |
| JP | 09-217406 | 8/1997 |
| KR | 20-0192991 | 8/2000 |
| KR | 20-0257146 | 12/2001 |
| KR | 10-2005-0122192 | 12/2005 |

*Primary Examiner* — Lori Baker

(74) *Attorney, Agent, or Firm* — Farjami & Farjami LLP

(57) ABSTRACT

The present invention relates to a drain device for draining wastewater, urine, etc. through a drainpipe and blocking bad odors emanating from the drainpipe, and more particularly, to a drain device comprising: an outer container coupled to a top of the drainpipe, a cover seated on a top of the outer container, a conical sloped plate coupled at a lower center of the cover, and a blocking layer formed in a trapezoidal cylindrical shape and coupled between the cover and the sloped plate, the blocking layer having a narrow upper inlet, a wide lower outlet, and a bent portion formed below the upper inlet. Accordingly, water is not left remaining, foreign objects are prevented from being entrapped and are discharged more easily, and the drain device can be reliably used for a long period of time without deforming.

8 Claims, 8 Drawing Sheets

DRAIN DEVICE

This is a U.S. national phase application which is based on, and claims priority from, PCT application Serial No. PCT/KR2010/002812, filed May 3, 2010, which claims priority from foreign application Serial No. 10-2009-0038643, filed May 1, 2009 in the Republic of Korea.

TECHNICAL FIELD

The present invention relates to a drain device for draining water having small viscosity, such as wastewater and urine, using a sloped plate and a blocking layer. More particularly, the present invention relates to a drain device, which can prevent the water from being left remaining, can prevent foreign objects from being entrapped to be discharged more easily, and can be reliably used for a long period of time without being deformed.

BACKGROUND ART

Generally, on a lower portion of a sink table for discharging wastewater, a bathroom, or a urinal for discharging urine, a typical drain trap for trapping a small amount of water is installed to prevent bad odors that emanate from a drainpipe from flowing backward. However, in the case of such a drain trap, the trapped water includes part of the wastewater or urine as described above, and thus, as a result, the bad odors emanate from the trapped wastewater or urine. Further, if the trapped water has been evaporated, the bad odors that flow backward from the drainpipe are unable to be blocked.

As illustrated in FIGS. 1 and 2, a drain device in the related art, which has been developed to solve the above-described problems, includes a trap main body 10 formed to be coupled to an upper end of a drainpipe, a cylindrical container 20 formed to receive wastewater from an upper portion thereof and to discharge the wastewater through a bottom thereof, a closed portion 30 in a bell shape that is connected from a center of the bottom of the cylindrical container; and an elastic container 40 formed in a cylindrical shape and having an upper portion that is coupled to an outer surface of the cylindrical container and a lower portion that is in close contact with an outer surface of the closed portion. Accordingly, if the wastewater or urine flows in through the cylindrical container 20, it is stored inside the closed portion 30 and the elastic container 40, and if a predetermined amount of water is stored, the elastic container 40 is open by the pressure of the water to discharge the stored water downward. After the water is discharged, the elastic container 40 is closed again and becomes in close contact with the outer surface of the closed portion 30 to prevent bad odors from flowing backward.

However, the drain device in the related art as described above has the problem in that the elastic container 40 is closed before the water stored in the elastic container 40 is not completely discharged, and thus a small amount of water that has not yet been discharged always remains. That is, if the pressure of the water that is stored in the elastic container 40 becomes larger than the elastic force of the elastic container 40, the elastic container 40 is open to start the water discharging. During this operation, if the pressure of the water stored in the elastic container 40 becomes smaller than the elastic force of the elastic container, the elastic container is closed again to trap the water. Accordingly, bad odors emanate from the remaining water.

Further, even in the case of discharging the water having small viscosity, such as the wastewater or urine, viscosity acts between the closed portion 30 and the elastic container 40, and foreign objects included in the water stick to outer surfaces and inner surfaces of the closed portion 30 and the elastic container 40. In this case, as illustrated in the drawing, since the outer surface of the closed portion 30 and the inner surface of the elastic container 40 are vertically in surface contact with each other, many foreign objects, which have failed to pass between the surfaces, get stuck more easily. These foreign objects that are stuck between the closed portion 30 and the elastic container 40 widen the gap between the closed portion 30 and the elastic container 40 to cause the bad odors from flowing backward.

On the other hand, since the viscosity of the water has a property of maintaining the closed portion 30 and the elastic container 40 in a closed contact state, the elastic container 40 may not be actually open even by the pressure of the water that is larger than the elasticity of the elastic container 40. Further, if there is no discharge of the water for a long time, the water and the foreign objects, which are present between the closed portion 30 and the elastic container 40, get dried and stuck to each other to block the discharge of the water.

Further, the drain device in the related art is required to be formed of a very flexible material in order to discharge the water and to block the bad odors by the elasticity that acts when the elastic container 40 is open or closed. However, the elastic container made of a flexible material may be lengthened during the repeated opening and closing operation thereof or may be deformed through the reduction of the elasticity of the elastic container due to chemical properties of the wastewater or urine.

Further, in the case where the elastic container 40 of a flexible material has been deformed, the bad odors emanating from the drainpipe directly rises up, and a gap occurs as the elastic container 40 is easily turned inside out or opened by wind that flows backward from the drainpipe to cause the bad odors to flow backward.

DISCLOSURE

Technical Problem

Therefore, the present invention has been made to solve the above-mentioned problems occurring in the related art.

The present invention is to solve the problem in that bad odors emanate due to remaining of the wastewater or urine which has failed to pass through the inside of the elastic container of the drain device in the related art.

The present invention is to solve the problem in that the closed portion and the elastic container, which are in surface contact with each other, get stuck to each other due to the viscosity that acts on the contact surfaces, and many foreign objects are easily entrapped between the contact surfaces in the related art.

The present invention is to solve the problem in that the elastic container is deformed during the repeated opening and closing operation thereof, and the elasticity of the elastic container is reduced due to chemical properties of the wastewater or urine, so that the bad odor blocking function or the wave discharging function is lowered, and thus the drain device in the related art is unable to be used for a long period of time.

The present invention is to solve the problem in that in the case where the elastic container of the drain device in the related art is deformed or is turned inside out by wind that flow backward from the drainpipe, the bad odors emanating from the drainpipe directly rises up.

Technical Solution

In accordance with an aspect of the present invention, there is provided a drain device for draining wastewater or urine through a drainpipe and blocking bad odors emanating from the drainpipe, which includes an outer container formed to be coupled to an upper end of the drainpipe; a cover seated on an upper end of the outer container and having plural drain outlets formed in the center thereof; a sloped plate coupled to the center of a lower portion of the cover to widen downward the center thereof; and a blocking layer formed in a cylindrical shape and including a narrow upper inlet that is coupled to an outer surface of the lower portion of the cover, a wide lower outlet that is in close contact with the sloped plate, and a bent portion formed on a lower side of the upper inlet to be bent while the bent portion is lifted up by the water that is trapped therein.

A water containing groove may be formed on a lower portion of the outer container to contain the water therein, and a partition may be formed on the lower portion of the sloped plate to sink in the water that is contained in the water containing groove.

The border of the sloped plate may stick out to be in line contact with an inner surface of the lower portion of the blocking layer.

At least one coupling groove may be formed up and down on an outer surface of the lower portion of the cover, at least one coupling ring may be formed on the inlet of the upper portion of the blocking layer to fit in the coupling groove, and a fixing ring thickly projecting may be formed on an outer surface of the outlet of the lower portion of the blocking layer to prevent the opening or distortion.

The bent portion of the blocking layer may be integrally formed of a flexible material with a thickness that is thinner than that of the intermediate portion or the lower portion thereof.

Advantageous Effect

According to the drain device according to an embodiment of the present invention, the wastewater or urine is completely discharged along the sloped plate as the cylindrical blocking layer having the narrow upper inlet and the wide lower outlet is lifted up, and thus the bad odors are prevented from emanating from the remaining water to achieve better health.

According to the drain device according to an embodiment of the present invention, since the sloped plate and the blocking layer are in line contact with each other, the foreign objects are prevented from being entrapped between the sloped plate and the blocking layer, and the sloped plate and the blocking layer are prevented from being stuck to each other due to the viscosity of the water, so that the drain device can be used more smoothly and reliably.

According to the drain device according to an embodiment of the present invention, since the bent portion is formed on the upper portion of the blocking layer so that the blocking layer repeats rising and falling to discharge the water, the lower portion of the blocking layer is prevented from being open or deformed, and thus the sealing between the blocking layer and the sloped plate can be maintained for a long period of time, so that the drain device can be used reliably.

According to the drain device according to an embodiment of the present invention, since the water containing groove for storing a small amount of water is formed on the lower portion of the outer container that is connected to the drainpipe and the partition is formed to be extended from the sloped plate to the water containing groove, the bad odors are blocked doubly through mutual complements, and the contained water is prevented from being evaporated. Further, the blocking layer is prevented from being turned inside out due to the wind that flows backward from the drainpipe.

BRIEF DESCRIPTION OF THE DRAWINGS

The above objects, other features and advantages of the present invention will become more apparent by describing the preferred embodiments thereof with reference to the accompanying drawings, in which.

*EXPLANATION OF REFERENCE NUMERALS OF MAIN PARTS IN THE DRAWINGS

Figure 1:
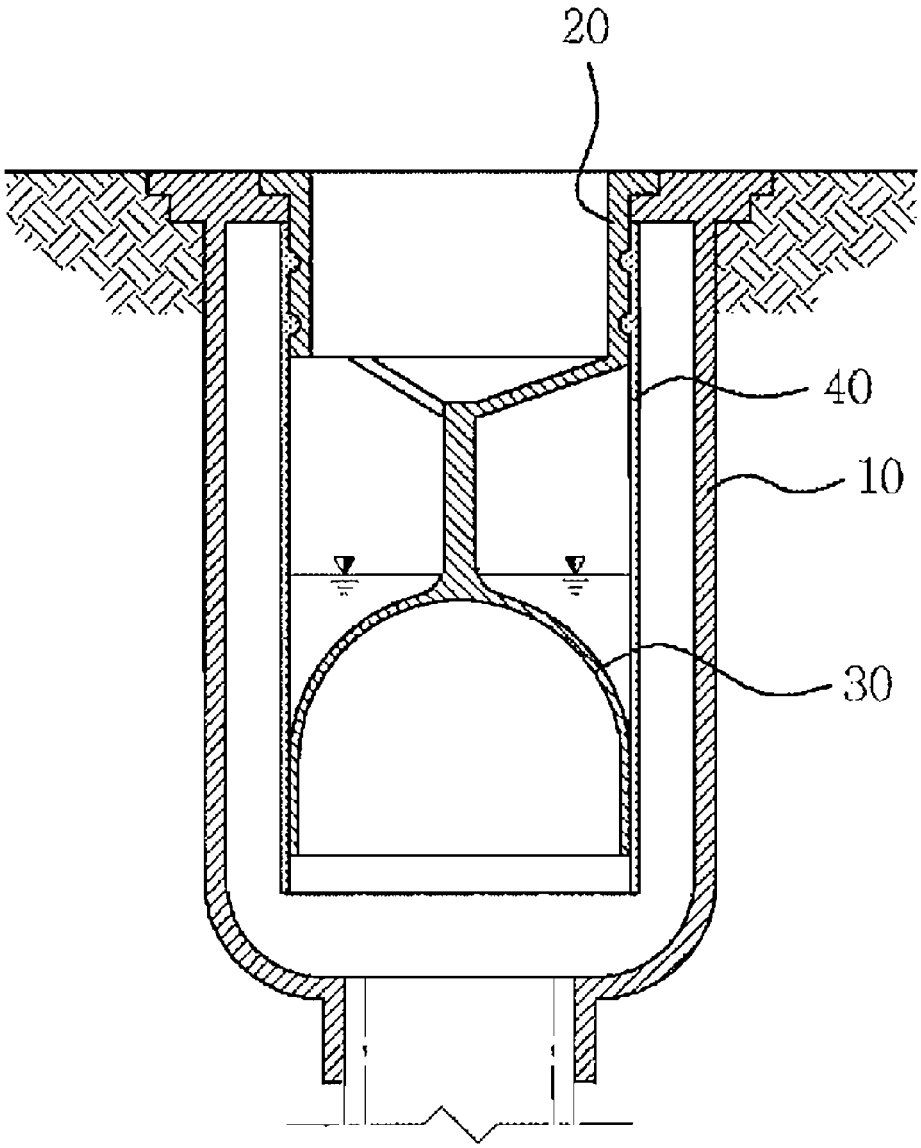
FIG. 1 (Prior Art)
FIG. 1 is a cross-sectional view illustrating a drain device in the related art.
Figure 2:
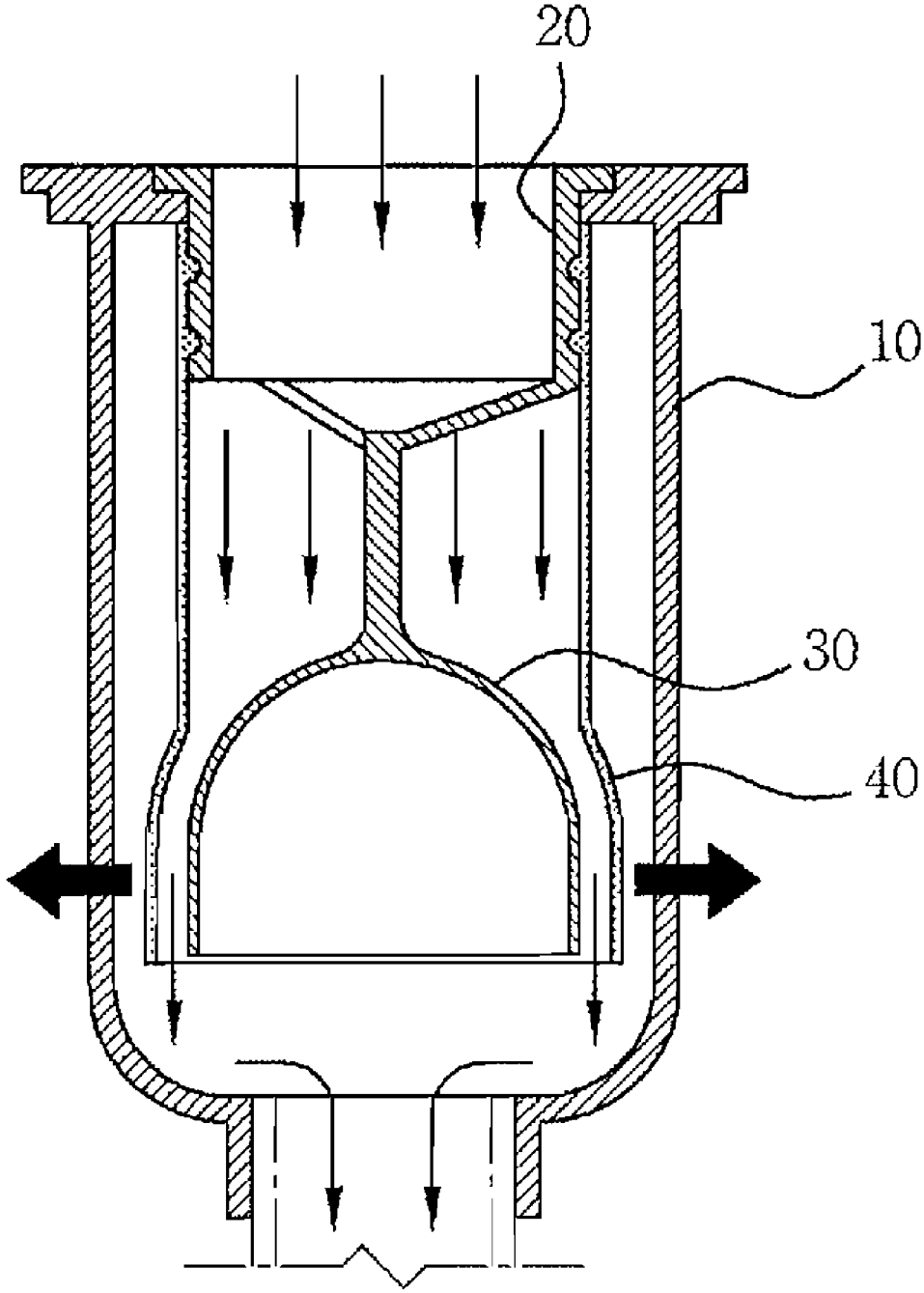
FIG. 2 (Prior Art)
FIG. 2 is a cross-sectional view illustrating an open state of a drain device in the related art.

100: outer container
110: water containing groove
200: cover
210: drain outlet
220: coupling groove
300: sloped plate
310: partition
400: blocking layer
410: bent portion
420: coupling ring
430: fixing ring

BEST MODE

Now, preferred embodiments of the present invention will be described in detail with reference to the accompanying drawings.

As illustrated in FIGS. 3 to 10, a drain device according to an embodiment of the present invention includes an outer container 100 coupled to an upper end of a drainpipe, a cover 200 seated on an upper end of the outer container 100, a sloped plate 300 coupled to the center of a lower portion of the cover, and a blocking layer 400 formed in a cylindrical shape and including a narrow upper inlet, a wide lower outlet, and a bent portion 410 formed on a lower side of the upper inlet.

Figure 3:
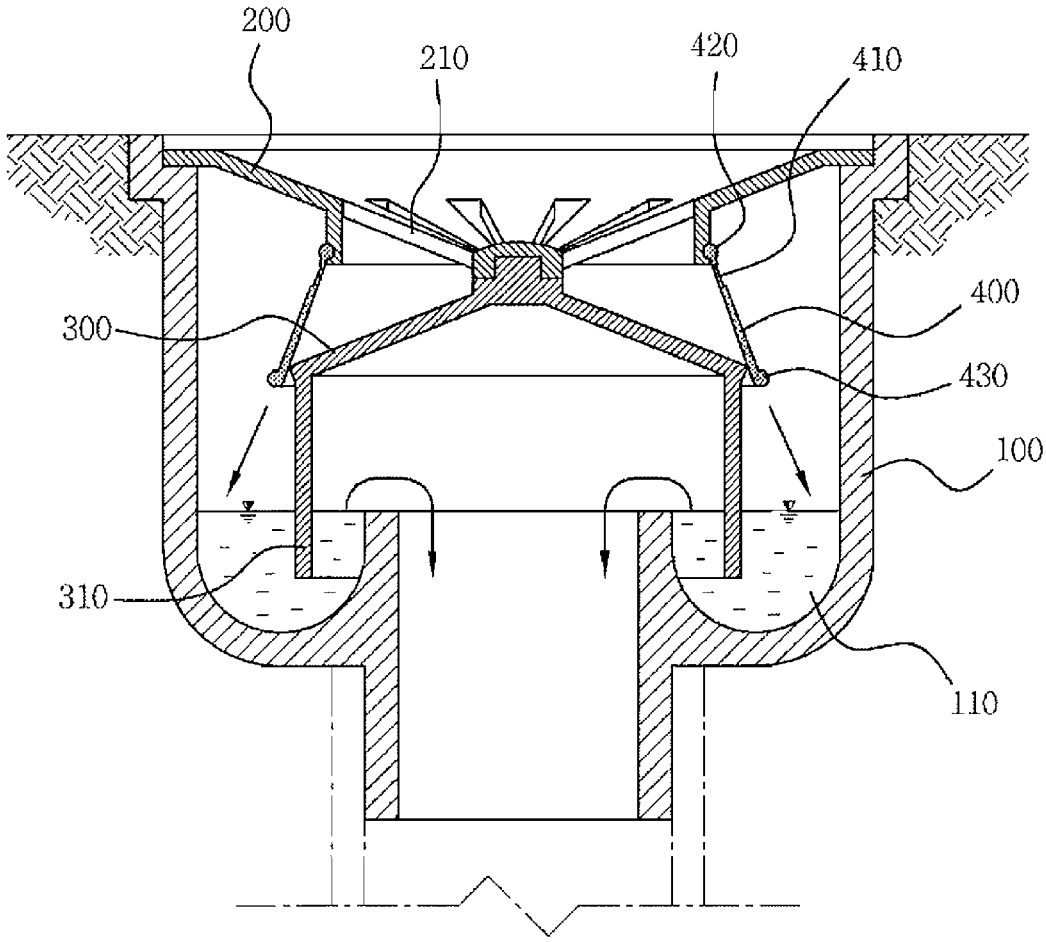
FIG. 3 is a cross-sectional view illustrating a drain device to which the present invention is applied.
Figure 4:
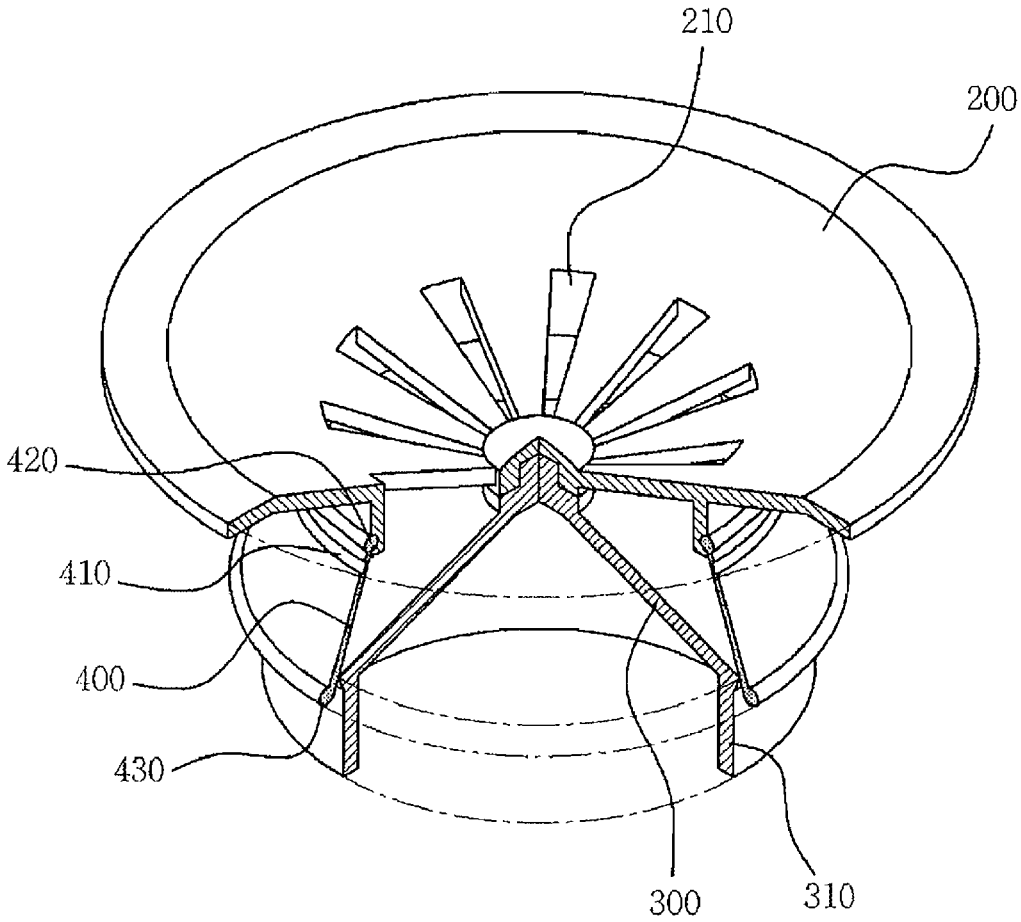
FIG. 4 is a partially cut perspective view illustrating a main part of a drain device to which the present invention is applied.

As illustrated in FIG. 3, the outer container 100 is installed on the bottom of a sink table, the bottom of a bathroom, or the lower portion of a urinal in a state where the outer container 100 is coupled to an upper end of the drainpipe. At an upper end of the outer container 100, a stepped portion for seating the cover 200 thereon is formed.

The border of the cover 200 is seated on the upper end of the outer container 100, and has plural drain outlets 210 formed on the center thereof. In this case, it is preferable that the drain outlets 210 are formed in a radial form from the center at equal intervals. As illustrated in the drawings, the center of the cover is formed convexly so that the water does not collect on the upper surface thereof, and a female screw or a male screw is formed on the lower portion thereof to couple the cover 200 to the sloped plate 300. In this case, a bolt hole for fastening the sloped plate 300 may be formed in the center of the cover 200.

The sloped plate 300 is coupled to the center of the lower portion of the cover 200, and is formed in a conical shape that widens from the center to the lower portion. In this case, in the center of the sloped plate 300, a male screw or a female screw is formed to fasten the sloped plate to the center lower portion of the cover 200. Preferably, the sloped plate 300 is formed in a conical shape having a slope of a predetermined angle within the range of 5 to 30° based on the horizontality, and the water that drops or is stored thereon is concentrated upon the lower portion of the blocking layer 400 while the pressure of the water acts in every direction. Accordingly, the slope of the sloped plate 300 is advantageous for the rising of the blocking layer 400. If the blocking layer 400 rises, the water rapidly passes through along the sloped surface and is completely discharged without remaining. In this case, if the slope angle of the sloped plate 300 is too small or too large, the pressure of the water is unable to be concentrated upon the lower portion of the blocking layer.

On the other hand, in the outer container 100 and the sloped plate 300, as illustrated in FIG. 3, a water containing groove 110 for containing the water therein is formed on the lower portion of the outer container 100, and a partition 310 in the form of a skirt is formed on the lower portion of the sloped plate 300 to sink in the water contained in the water containing groove 110. According to this construction, even if an exceptional case, such as damage of the blocking layer 400, occurs, the bad odors that emanate from the drainpipe can be blocked, and even if strong wind flows backward from the drainpipe, it does not directly exert an influence on the blocking layer 400 to prevent the blocking layer 400 from being lifted up or being turned inside out. It is preferable that the water containing groove 110 has a curved structure so that the existing contained water is reversed by only a small amount of water newly flowing into the groove.

The blocking layer 400 is formed in a cylindrical shape that includes a narrow upper inlet and a wide lower outlet so that it is lifted up by the pressure of the water. The upper inlet is coupled to an outer surface of the lower portion of the cover 200, the lower outlet is in close contact with the sloped plate 300, and the bent portion 410 is formed on the lower side of the upper inlet so that it is bent while being lifted up by the water that is trapped therein. That is, by forming the blocking layer 400 that is in the cylindrical shape including the narrow upper inlet and the wide lower outlet, the pressure of the water acting on the lower portion of the blocking layer 400 becomes larger than the pressure acting on the upper portion of the blocking layer 400, and thus the blocking layer 400 is lifted up without being expanded. In this case, it is preferable that the blocking layer 400 is formed to have a slope of a predetermined angle within the range of 5 to 45° based on the vertical surface. The blocking layer 400 of this type is distinct from the elastic container in the related art which has the cylindrical upper inlet and the cylindrical lower outlet, and thus is horizontally open rather than being lifted up.

Figure 10:
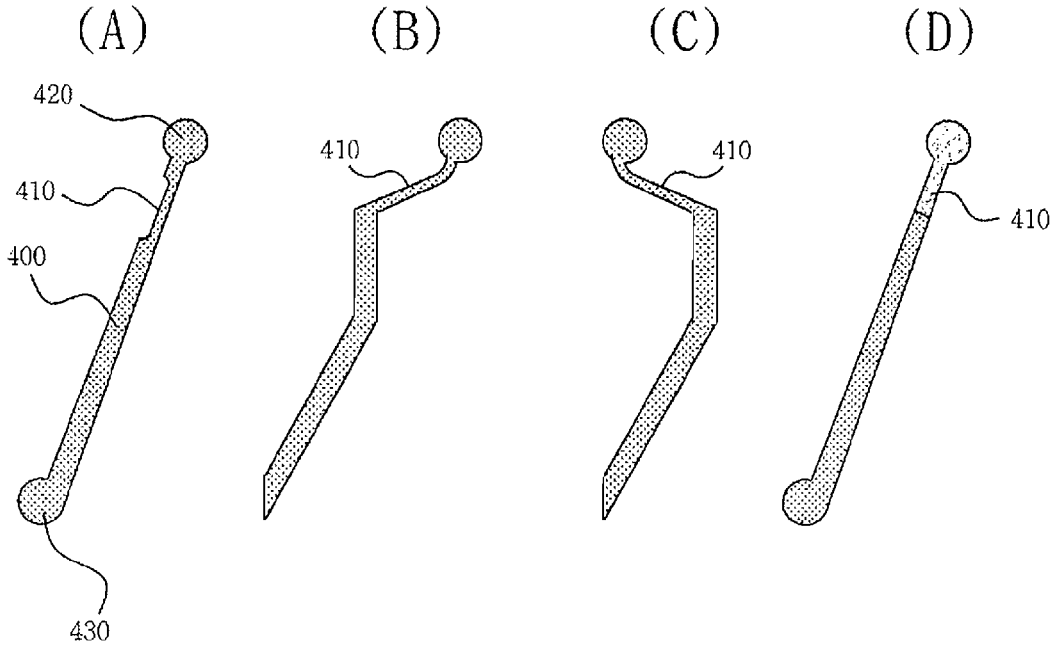
FIG. 10 is another exemplary view illustrating a drain device to which the present invention is applied.

The bent portion 410 of the blocking layer 400 is formed so that it is bent more easily than other portions when the pressure of the water acts thereon, and may be formed in various shapes as illustrated in FIG. 10. That is, as illustrated in (A) of FIG. 10, the bent portion 410 of the blocking layer 400 may be provided by forming a ring-shaped groove through thinning of a predetermined portion of the outer surface thereof. Further, as illustrated in (B) or (C) of FIG. 10, the upper portion may be thinned and sloped toward the inside or outside, and the intermediate portion and the lower portion may be formed to be thick in a state where the intermediate portion is vertically formed and the lower portion is formed to be sloped toward the outside.

Further, as illustrated in (D) of FIG. 10, the intermediate portion and the lower portion of the blocking layer 400 may be formed of any one of metal, synthetic resin, and rubber, which is not easily open by the pressure of the water, and the bent portion 410 may be formed of soft synthetic resin or rubber, which is easily bent.

By forming the bent portion 410 as described above, the elasticity is not surely necessary, and thus the blocking layer 400 can be formed of any material that can be easily bent on the bent portion 410. That is, the blocking layer 400 is distinct from the elastic container in the related art, which surely requires the elasticity since it is required for the elastic container in the related art, which is firmly in close contact with the closed portion, to be expanded by the pressure of the water, and then to return to its original shape when the pressure of the water is reduced. It is preferable that the blocking layer 400 is formed of a material having no elasticity or low elasticity so that it is lifted up without being open by the pressure of the water that intensively acts on the lower portion thereof. Accordingly, the blocking layer 400 is easily bent on the bent portion 410, and the intermediate portion and the lower portion thereof, which receive the pressure of the water, are formed of metal, synthetic resin, or rubber.

Figure 5:
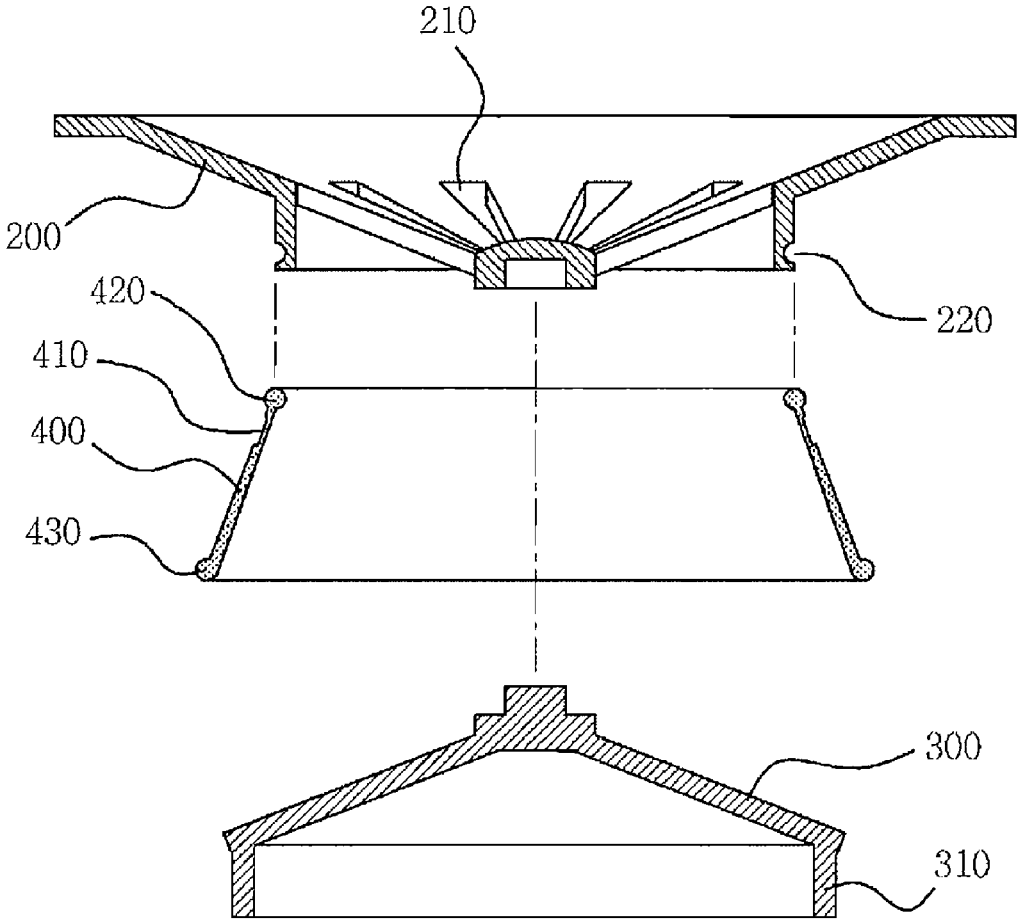
FIG. 5 is an exploded cross-sectional view illustrating a main part of a drain device to which the present invention is applied.
Figure 6:
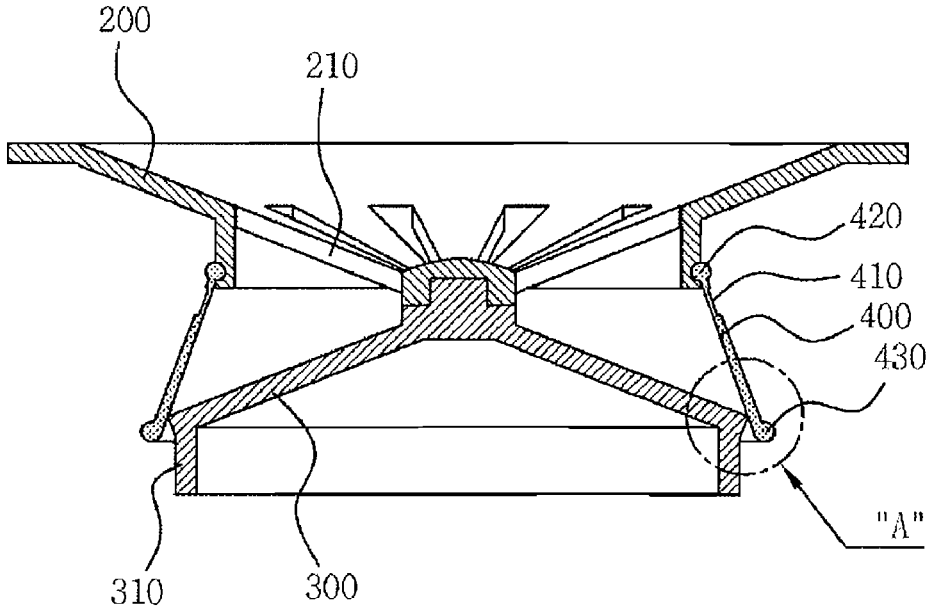
FIG. 6 is a combined cross-sectional view illustrating a main part of a drain device to which the present invention is applied.
Figure 7:
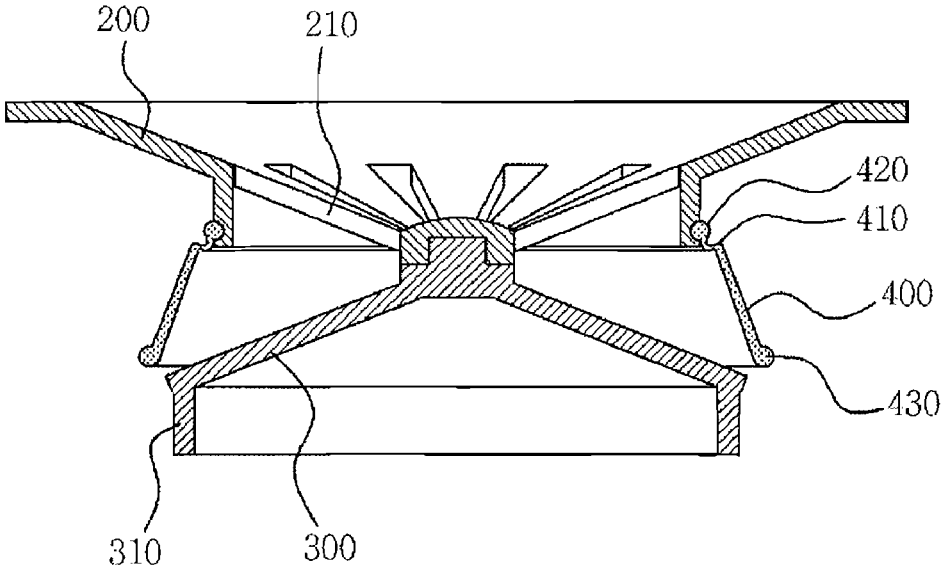
FIG. 7 is a cross-sectional view of an open state illustrating a main part of a drain device to which the present invention is applied.

On the other hand, as a means for coupling the blocking layer 400 to the cover 200, as illustrated in FIG. 5, one or more coupling grooves 220 may be formed up and down on the outer surface of the lower portion of the cover 200, and one or more coupling rings 420 may be formed on the inlet of the upper portion of the blocking layer 400 to fit in the coupling grooves, respectively. The fixing ring 420 is integrally formed with the blocking layer 400 with large thickness, so that the coupling ring 420 is not easily taken out after being inserted into the coupling groove 220. Other methods that enable the coupling groove 220 and the coupling ring 420 to be coupled to each other permanently and reliably may be used as a means for coupling the cover and the blocking layer 400 to each other.

Further, on the outer surface of the outlet of the lower portion of the blocking layer 400, a fixing ring 430 that thickly projects may be formed to prevent the opening or distortion.

Figure 9:
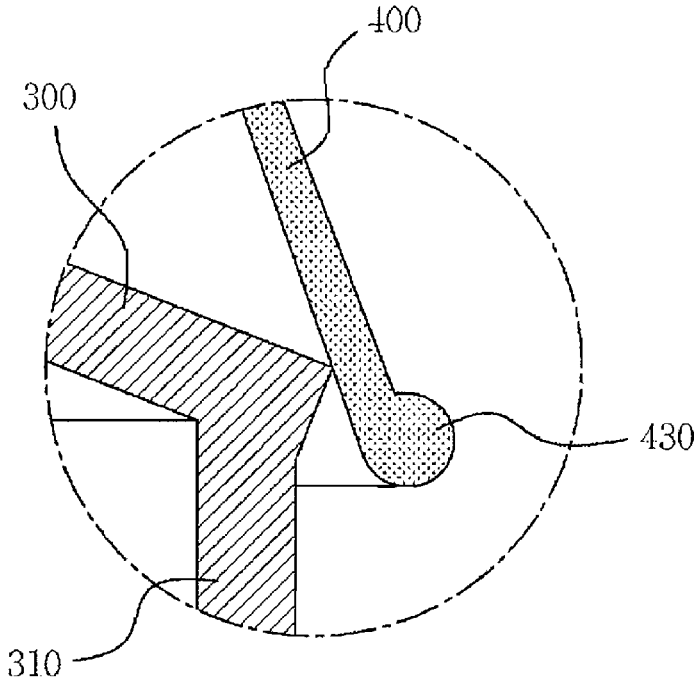
FIG. 9 is an enlarged view illustrating a part "A" of a drain device to which the present invention is applied.

Since the sloped plate 300 and the blocking layer 400 are in close contact with each other through line contact rather than surface contact, the influence of the viscosity of the water is reduced, and the range in which foreign objects are entrapped between the sloped plate 300 and the blocking layer 400 can be maximally reduced. Accordingly, as illustrated in FIG. 9, the border of the sloped plate 300 may stick out to be in line contact with the inner surface of the lower portion of the blocking layer 400.

Figure 8:
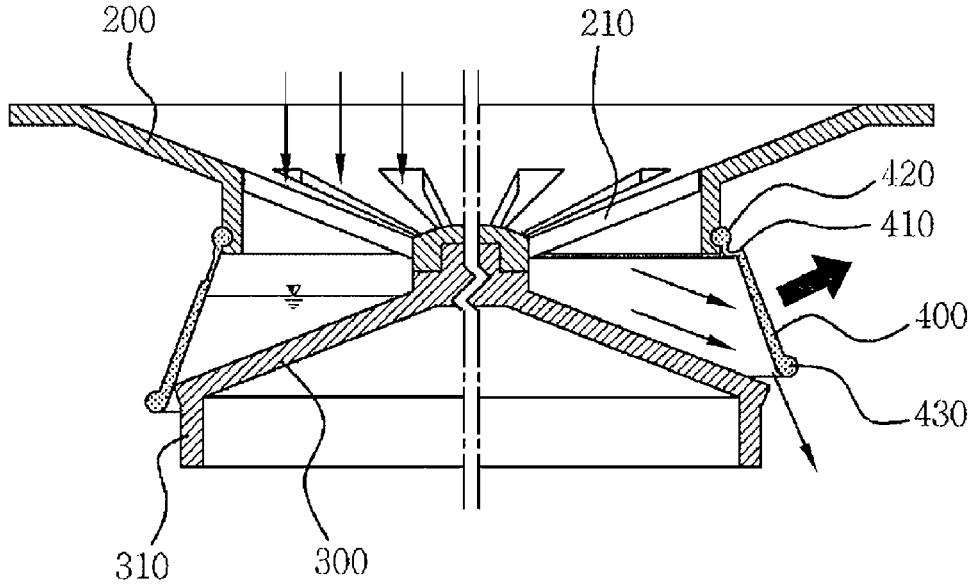
FIG. 8 is a cross-sectional view of an operation state illustrating a main part of a drain device to which the present invention is applied.

According to the drain device having the above-described construction, as illustrated in FIG. 8, if the wastewater or urine flows through the cover 200 and is stored between the cylindrical blocking layer 400 having the narrow upper inlet and the wide lower outlet and the sloped plate 300, the pressure of the stored water concentrately acts on the lower portion of the blocking layer 400 along the sloped plate 300 having a slope of a predetermined angle to push the blocking layer 400 outwardly and upwardly. In this case, since the blocking layer 400 is not open outwardly, the pressure that pushes the blocking layer 400 outwardly acts concentrately to lift the blocking layer upwardly. Accordingly, the bent portion 410, which is relatively weak with respect to the pressure of the water that lifts the blocking layer 400, is bent and rises, and thus the water that is stored between the sloped plate 300 and the blocking layer 400 passes downward. In this case, since the store water rapidly passes through along the sloped surface of the sloped plate 300 and continuously lifts the lower portion of the blocking layer 400, the blocking layer 400 becomes in close contact with the sloped plate 300 only after the stored water passes completely.

Accordingly, the wastewater or urine is completely discharged without remaining inside the sloped plate 300 and the blocking layer 400, and thus the bad odors are prevented from emanating from the remaining water or urine to achieve better health. Further, by the line contact between the sloped plate 300 and the blocking layer 400, the foreign objects are prevented from being entrapped between the sloped plate and the blocking layer, and the sloped plate and the blocking layer are prevented from being stuck to each other due to the viscosity of the water. Further, the lower portion of the blocking layer 400 is prevented from being open or deformed, and thus the sealing between the blocking layer 400 and the sloped plate 300 can be reliably maintained for a long period of time.

Further, since the water containing groove 110 for storing a small amount of water is formed on the lower portion of the outer container 100 that is connected to the drainpipe and the partition 310 is formed to be extended from the sloped plate 300 to the water containing groove 110, the bad odors are blocked doubly through the mutual complements, and the contained water is prevented from being evaporated. Further, the blocking layer 400 is prevented from being turned inside out due to the wind that flows backward from the drainpipe.

While this invention has been described in connection with what is presently considered to be the most practical and preferred embodiments, it is to be understood that the invention is not limited to the disclosed embodiment and the drawings. On the contrary, it is intended to cover various modifications and variations within the spirit and scope of the appended claims.

The invention claimed is:

1. A drain device for draining wastewater or urine through a drainpipe and blocking bad odors emanating from the drainpipe, comprising:

an outer container formed to be coupled to an upper end of the drainpipe;

a cover seated on an upper end of the outer container and having plural drain outlets formed in the center thereof;

a sloped plate coupled to the center of a lower portion of the cover to widen downward the center thereof; and a blocking layer formed in a cylindrical shape and including a narrow upper inlet that is coupled to an outer surface of the lower portion of the cover, a wide lower outlet that is in close contact with the sloped plate, and a bent portion formed on a lower side of the upper inlet to be bent while the bent portion is lifted up by the water that is trapped therein.

2. The drain device according to claim 1, wherein a water containing groove is formed on a lower portion of the outer container to contain the water therein, and a partition is formed on the lower portion of the sloped plate to sink in the water that is contained in the water containing groove.

3. The drain device according to claim 1, wherein a border of the sloped plate sticks out to be in line contact with an inner surface of the lower portion of the blocking layer.

4. The drain device according to claim 1, wherein an intermediate portion of the blocking layer is formed vertically, the lower portion thereof is formed to be sloped outwardly, and the upper portion thereof is formed to be sloped inwardly or outwardly.

5. The drain device according to claim 1, wherein the lower portion of the blocking layer is formed of any one of metal, synthetic resin, and rubber, which is not easily open by pressure of the water, and the bent portion is formed of synthetic resin or rubber, which is easily bent.

6. The drain device according to claim 2, wherein the lower portion of the blocking layer is formed of any one of metal, synthetic resin, and rubber, which is not easily open by pressure of the water, and the bent portion is formed of synthetic resin or rubber, which is easily bent.

7. The drain device according to claim 3, wherein the lower portion of the blocking layer is formed of any one of metal, synthetic resin, and rubber, which is not easily open by pressure of the water, and the bent portion is formed of synthetic resin or rubber, which is easily bent.

8. The drain device according to claim 4, wherein the lower portion of the blocking layer is formed of any one of metal, synthetic resin, and rubber, which is not easily open by pressure of the water, and the bent portion is formed of synthetic resin or rubber, which is easily bent.

* * * * *